US007178461B2

(12) United States Patent
Keller

(10) Patent No.: US 7,178,461 B2
(45) Date of Patent: Feb. 20, 2007

(54) INK FOUNTAIN ASSEMBLY WITH NON-TILT CHEEKS AND LINER REPLACEMENT MECHANISM

(75) Inventor: James J. Keller, Scottsdale, AZ (US)

(73) Assignee: Color Control Corp., Scottsdale, AZ (US)

( * ) Notice: Subject to any disclaimer, the term of this patent is extended or adjusted under 35 U.S.C. 154(b) by 112 days.

(21) Appl. No.: 10/837,901

(22) Filed: May 3, 2004

(65) Prior Publication Data

US 2004/0255803 A1 Dec. 23, 2004

Related U.S. Application Data

(63) Continuation-in-part of application No. 10/314,738, filed on Dec. 9, 2002, now Pat. No. 6,802,255.

(60) Provisional application No. 60/467,384, filed on May 2, 2003.

(51) Int. Cl.
*B41F 31/05* (2006.01)

(52) U.S. Cl. ..... 101/365

(58) Field of Classification Search ..... 101/365, 101/364, 335

See application file for complete search history.

(56) References Cited

U.S. PATENT DOCUMENTS 1,953,105 A 4/1934 Flinker (Continued)

OTHER PUBLICATIONS

USA Internet Advertisement Heidelberg T&D Remarketed Services, Inc. www.tanddmachine.com/Process/Inkers.htm Aug. 15, 2003.

(Continued)

*Primary Examiner*—Judy Nguyen
*Assistant Examiner*—Leo T. Hinze
(74) *Attorney, Agent, or Firm*—Osha Liang LLP; John W. Montgomery

(57) ABSTRACT

A non-tilt cheek assembly is provided for use in an ink fountain assembly. An ink fountain mechanism for adjustably metering the thickness of the layer of ink in a plurality of zones axially across a fountain roller for a printing press. The ink fountain mechanism includes a plurality of metering blocks, horizontally aligned and axially adjacent to one another with side-by-side upper support surfaces forming a substantially continuous support surface along the length of the fountain roller. Each upper surface of the metering blocks is adjustably spaced from the fountain roller to control the amount of ink, in a zone corresponding to the side-to-side length of the support surface of each metering block. A plurality of adjustment bolts are each separately and threadably engaged with each of the plurality of metering blocks. The adjustment bolts are slideably supported in a main beam that extends the length of the fountain roller. A plurality of lever-actuated cams are pivotably held adjacent to the heads of each of the adjustment bolts. Metering cams are engaged with the heads of the adjustment bolts and are progressively actuatable between a minimum position, providing a minimum ink metered thickness, and a maximum position, providing a maximum metered ink thickness. A replaceable liner is provided and a pivot mount having an operating position with the replaceable liner immediately adjacent to the fountain roller and a liner replacement position with the liner pivoted away from the fountain roller so that it can be conveniently removed.

7 Claims, 9 Drawing Sheets

U.S. PATENT DOCUMENTS 2,301,535 A 11/1942 Green
2,902,927 A 9/1959 Ross
3,057,294 A 10/1962 Jameson
3,135,197 A 6/1964 Dutro et al.
3,339,485 A 9/1967 Rytterholm
3,498,650 A * 3/1970 John ..... 403/373
3,561,360 A 2/1971 Branfield et al.
3,788,220 A 1/1974 Laben et al.
3,792,659 A 2/1974 Albrecht
3,831,517 A 8/1974 Wagner
4,023,485 A 5/1977 Kirby
4,050,380 A 9/1977 Pfizenmaier
4,052,936 A 10/1977 Pabodie
4,155,303 A 5/1979 Johnston
4,164,185 A 8/1979 Kirby
4,165,688 A 8/1979 Leanna
4,361,089 A 11/1982 Wittkopf
4,366,754 A 1/1983 Sarda
4,419,932 A 12/1983 Cappel
4,479,434 A 10/1984 Armelin
4,495,865 A 1/1985 Junghans
4,584,941 A 4/1986 Weber
4,796,528 A 1/1989 Sarazen
4,960,052 A 10/1990 Junghans
5,012,736 A 5/1991 Van Kanegan
5,042,381 A 8/1991 Thompson
5,138,944 A 8/1992 Rancourt
5,150,651 A 9/1992 Flores
5,174,210 A 12/1992 Rodi et al.
5,182,989 A 2/1993 D'Heureuse
5,341,740 A 8/1994 Guaraldi
5,363,763 A 11/1994 Fiore
5,481,974 A 1/1996 Sarazen et al.
5,603,263 A 2/1997 Dufour et al.
5,662,042 A 9/1997 Compton
5,694,850 A * 12/1997 Pickard ..... 101/365
5,694,851 A 12/1997 Bruni
5,727,463 A 3/1998 Deschner et al.
5,749,665 A 5/1998 Kato et al.
5,761,999 A 6/1998 Lippold et al.
5,809,887 A 9/1998 Blackwell et al.
5,927,199 A 7/1999 Achelpohl et al.
5,960,715 A 10/1999 Voge et al.
5,974,966 A 11/1999 Bruni
5,979,321 A 11/1999 Kippelkamm et al.
6,012,389 A 1/2000 Roskosch et al.
6,112,661 A 9/2000 Albiez
6,349,645 B1 2/2002 Roskosch
6,481,352 B2 11/2002 Mayer
6,546,869 B1 4/2003 Eltner et al.
6,584,901 B1 7/2003 Sarda
6,598,525 B2 7/2003 Metrope
6,802,255 B2 * 10/2004 Keller et al. ..... 101/365
2002/0134263 A1 9/2002 Metrope

OTHER PUBLICATIONS

USA Internet Advertisement Policrom, Inc. Press Consumables www.policrom.com/Press_consumables/press_consumables.html Aug. 15, 2003.

* cited by examiner

INK FOUNTAIN ASSEMBLY WITH NON-TILT CHEEKS AND LINER REPLACEMENT MECHANISM

RELATED APPLICATIONS

This is a continuation-in-part application of U.S. Utility patent application Ser. No. 10/314,738, filed on Dec. 9, 2002, now U.S. Pat. No. 6,802,255 and U.S. provisional application 60/467,384, filed May 2, 2003 titled NON-TILT CHEEKS FOR INK FOUNTAIN ASSEMBLY, both incorporated herein by reference for all legitimate purposes and relied upon for priority.

FIELD OF INVENTION

The present application relates to an ink fountain mechanism for a rotary offset printing press, and in particular to non-tilt cheeks and a liner replacement mechanism for an ink fountain assembly.

DETAILED DESCRIPTION

Figure 1:
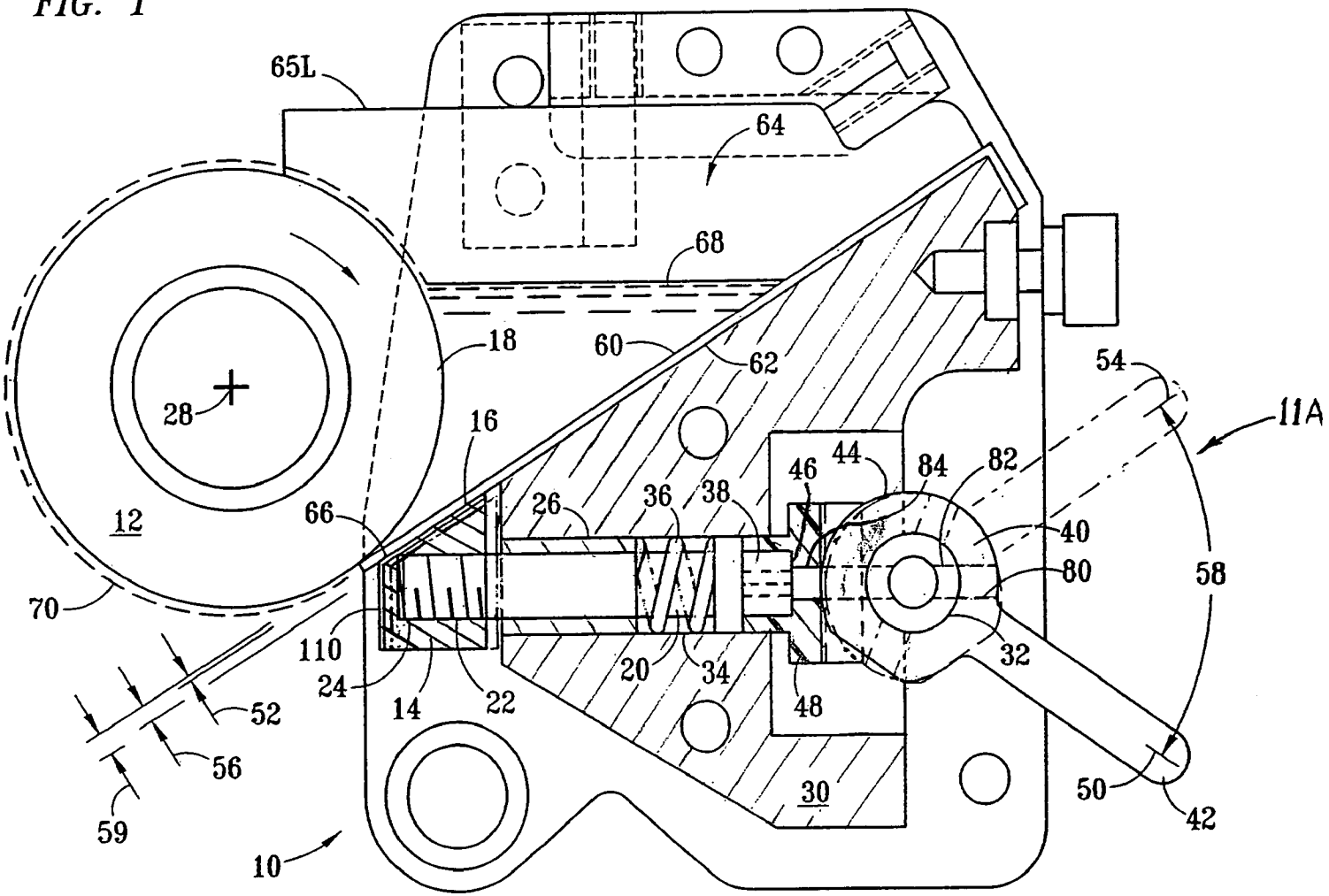
FIG. 1 is a schematic partial cross-sectional side view of an ink fountain mechanism according to one embodiment of the present invention.
Figure 2:
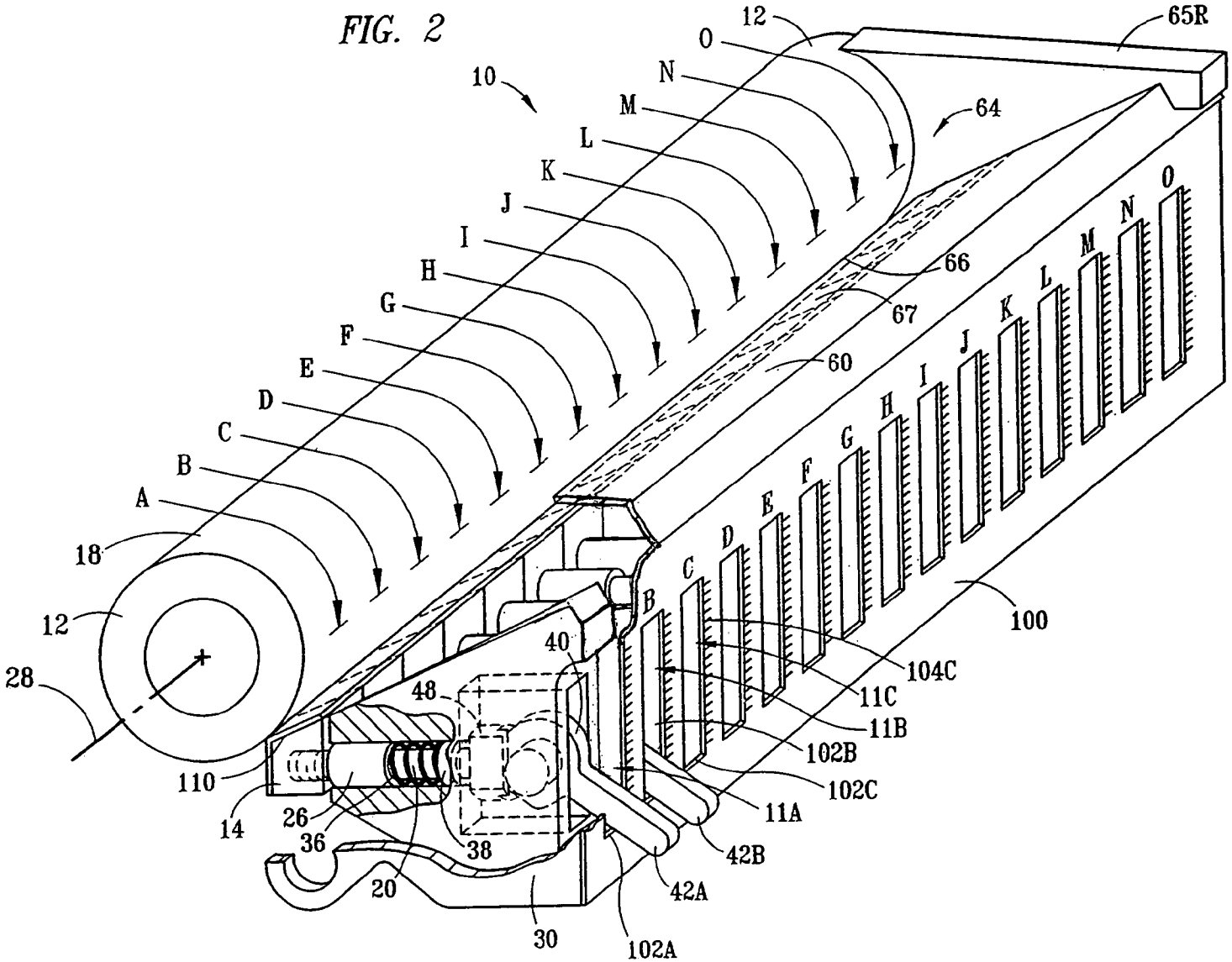
FIG. 2 is a partial cutaway perspective view of the ink fountain mechanism of FIG. 1.
Figure 3:
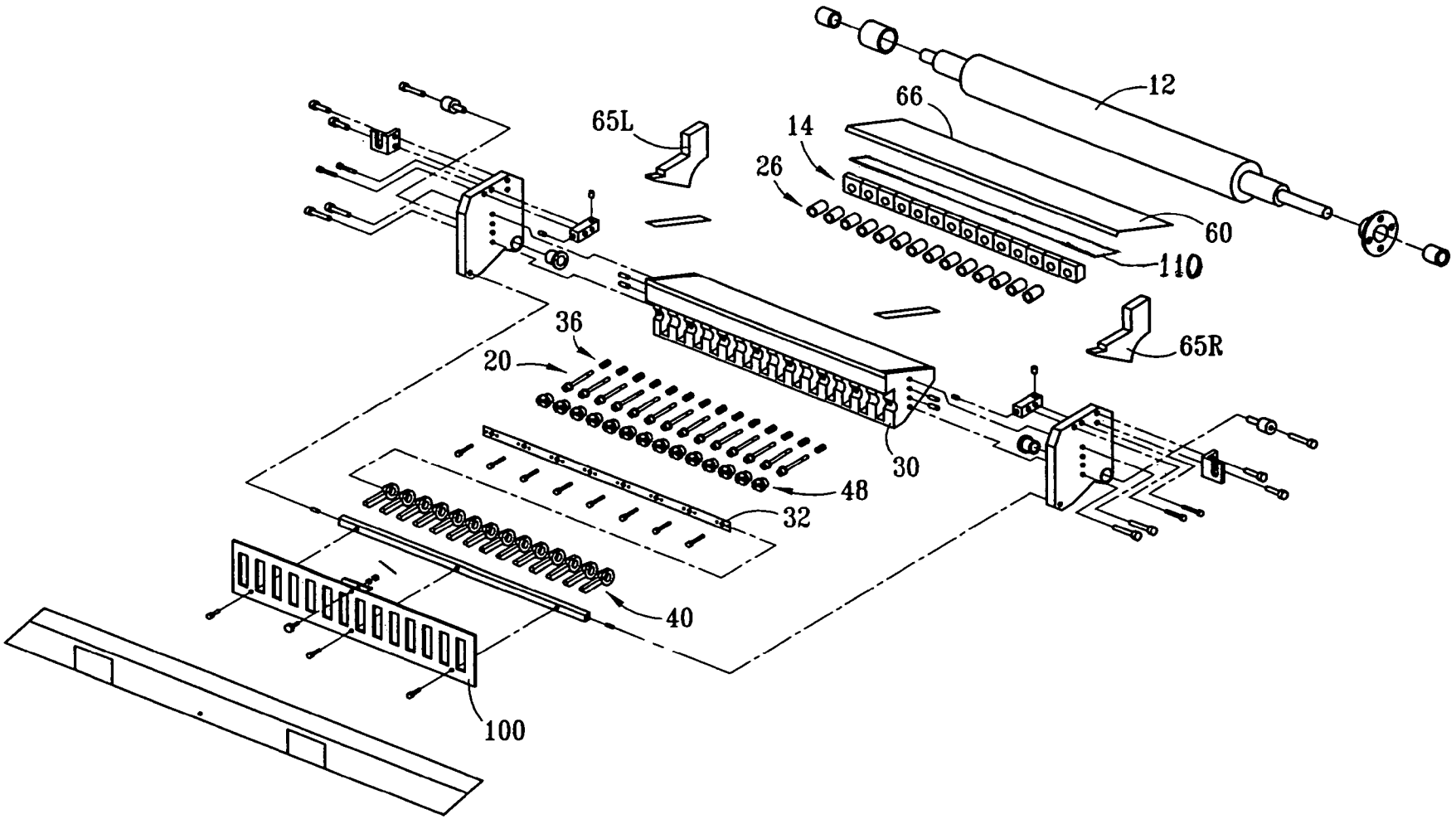
FIG. 3 is an exploded assembly view of the ink fountain mechanism of FIGS. 1 and 2.

Referring to FIGS. 1–3, it will be understood that an ink fountain mechanism 10, according to one embodiment of the present invention, comprises a plurality of sub-assemblies 11A–O. The number of sub-assemblies 11A–O may be varied without departing from the invention and may be greater or fewer depending, in part, upon the width of the printing press for which it is designed. As will be more fully understood with reference to the figures and description, the present invention provides a unique, simplified, reliable and improved ink fountain mechanism 10 for adjustably metering the thickness of a layer of ink dispensed by a fountain roller 12 in a plurality of zones A–O. Each zone A–O is generally defined as a circumferential area or band adjacent to one of a plurality of substantially identical sub-assemblies 11A–O, and the number of zones A–O may be varied without departing from the invention. One sub-assembly 11A is positioned next to another zone 11B which is next to another zone 11C and etc., along the length of the fountain roller 12. Each zone is primarily acted upon by similar components of an adjacent sub assembly. For clarity, the embodiment of FIG. 1 will be described with respect to a single sub-assembly 11A and the interrelationship between the plurality of sub-assemblies 11A–O in zones A–O will be more fully explained with reference to FIGS. 2 and 3 below.

FIG. 1 is a schematic partial cross-sectional side view of the ink fountain mechanism 10 adjacent to a fountain roller 12. The ink fountain mechanism 10 includes a metering block 14 that is horizontally aligned with and axially adjacent to other metering blocks 14 in other sub-assemblies. Each metering block 14 has an upper surface 16 adjustably spaced outward in a radial direction from an outer cylindrical surface 18 of ink receiving fountain roller 12. An adjustment bolt 20 has external threads 22 and is separately and threadably engaged with internal threads 24 formed in each metering block 14. A bushing 26 slideably supports the adjustment bolt 20. The bushing 26 is supported in a bore 34 formed in a main beam 30. The main beam 30 extends parallel to the axis 28 and along the length of the fountain roller 12. A cam 40 is mounted for partial rotation on a mounting shaft 32 held by the main beam 30. The cam 40 comprises an eccentric cam surface 44 and an actuation lever 42 attached or integrally formed for manual lever actuation. The eccentric surface 44 of the cam 40 is eccentric with respect to the mounting shaft 32. The cam 40 is positioned adjacent to a head 38 of the adjustment bolt 20. The eccentric surface 44 interfaces, or is otherwise coupled or engaged, with the head 38 of the adjustment bolt 18. In the embodiment shown, the engagement of the cam surface 44 with the adjustment bolt 20 is through an interposed interface cap 48. The cam 40 is manually actuatable with lever 42 between a minimum position 50, providing a minimum ink metered thickness at 52, and a maximum position 54, providing maximum metered ink thickness 56. The lever 42 actuates the cam 40 progressively within a range 58 of positions between the minimum and maximum positions, 50 and 54 respectively. This provides substantially continuous metering of the thickness of ink in a thickness range 59 between the minimum and the maximum ink thickness, 52 and 56 respectively. An ink liner 60 comprises a thin sheet of resilient and flexible material supported at an inclined angle by an inclined base 62 of an ink fountain reservoir 64. The ink liner 60 is supported at and along a dispensing edge 66 by the upper surface 16 of the metering block 14. The ink 68 to be dispensed and metered by the ink fountain mechanism 10 is held in the reservoir 64. The ink flows by gravity and by the rolling contact with surface 18 of fountain roller 12. The ink 68 is "squeezed" or metered between the edge 66 of the ink liner 60 and the surface 18 of ink fountain roller 12. This provides a metered thickness layer 70 of ink 68 onto the surface 18 of the fountain roller 12.

According to one embodiment, each adjustment bolt 20 is biased toward a corresponding cam 40. For example, a return spring 36 may be held with its coils around bolt 20 and within a bore 34 in the main beam 30. In this configuration the spring 36 pushes against the head 38 of adjustment bolt 20. A top surface 46 of the head 38 of the adjustment bolt 20 is thus biased toward the cam 40. In one embodiment, the bolt head 38 comprises a cap screw head, such as an Allen bolt head, and the bolt head 38 interfaces with the cam through the interface cap 48. The interface cap 48 is attachable to the head 38 of bolt 20 and constructed of a material selected to provide non-binding frictional sliding contact between the cam surface 44 and the interface cap 48. The size, shape, and materials of the interface cap 48 and the cam 40 are selected and constructed for a desired frictional coefficient at the interface therebetween. In one construction, the cam 40 and cam arm 42 are integrally formed having a consistent size and shape from one cam to the next using sintered powdered metal technology and the interface cap 48 is formed of an acetal resin, such as Delrin (a trademark of DuPont for such an acetal resin material).

The cam lever 42 is moveable by a press operator to adjust the ink fountain mechanism 10, with manually applied force. The cam lever 42 can be manually moved through the position range 58 for providing the thickness range 59 of metered ink thickness. The bias force of spring 36 and the frictional coefficient between canm surface 44 and interface cap 48 act to retain the cam lever 42 and cam 40 in any desired metering position as may be manually selected by the press operator. External force applied to the cam lever 42 is required to change the metering position. Each of the cam levers 42A–O of each sub-assembly 11A–O may be separately positioned to meter the ink thickness at each of the separate metering blocks 14A–O.

According to another aspect the invention, each cam 40 is mounted on a mounting shaft 32 for rotation between the minimum and maximum metering positions, 50 and 54 respectively. A first adjustment orifice 80 is formed through each cam 40 extending diametrically through the cam 40. At each sub-assembly position along the mounting shaft, a second adjustment orifice 82 is formed diametrically through the mounting shaft 32. Each second adjustment orifice 82 is aligned with each bolt 20 and each siding hole 26. The interface cap 48 is also provided with a third orifice 84 centrally located for alignment with the head 38 of the bolt 20 and with the second orifice 82. Each first orifice 80 is formed in each cam 40 so that each first and second orifices, 80 and 82, are aligned when the cam 40 is in the minimum ink thickness position 50 of lever arm 42.

In the embodiment depicted in FIG. 1, the minimum position 50 of lever arm 42 corresponds to the downward position. When aligned, the first second and third orifices, 80, 82, and 84 respectively, permit an adjustment tool 90 to be extended through the cam 40, through the mounting shaft 32, and through the interface cap 48 for engagement with the head 38 of adjustment bolt 20. The adjustment tool 90 engages with the head of the bolt 20 and may be rotated in one direction to thread the adjustment bolt 20 into the metering block 14. The bolt 20 may be rotated the other direction to thread the adjustment bolt 20 out of the metering block 14. Finely threaded bolts 20 are used for precisely adjusting the position the metering block 14 relative to the main beam 30 and thus relative to the fountain roller 12 when the cam lever arm 42 of cam 40 is in the minimum position 50. The position of the metering block 14, relative to the fountain roller 12, determines the position of the ink liner relative to the roller surface 18. Thus, the minimum thickness 52 of the ink 68 in layer 70 is precisely adjustable at each metering block 14 when each cam 40 is at its minimum position 50. The maximum thickness 56 of the ink 68 in layer 70 will also be adjusted upon adjusting the minimum thickness 52 because the eccentric lift of the cam 40 between the minimum position and the maximum position does not change. For example, consider a cam 40 having an eccentric lift of twenty thousandths of an inch (0.020 inch), from the minimum position 50 to the maximum position 54. The minimum thickness 52 can be adjusted by tuning adjustment bolt 20. An adjustment of the minimum thickness 52, from one thousandth of an inch (0.001 inch) thick to zero, will simultaneously adjust the maximum thickness from twenty-one thousandths of an inch (0.021 inch) thick to twenty thousandths of an inch (0.020 inch) thick.

Referring now to FIG. 2, an ink fountain mechanism 10 according to an exemplary embodiment of the invention is depicted in a partial cutaway perspective view. A plurality of sub-assemblies 11A–O each constructed as described above with respect to FIG. 1 are provided adjacent to a plurality of zones A–O, indicated generally with arrows labeled A–O. The ink reservoir 64 is formed between the fountain roller 12, the ink liner 60 and two side plates 65L and 65R on opposite ends of the ink fountain mechanism 10. The ink liner 60 preferably comprises a thin sheet of resiliently flexible plastic material. A sheet of 7 mils thick polyester has been found to be useful for purposes of the present invention. The ink liner is supported at an oblique angle relative to horizontal so that ink 68 in the reservoir 64 will flow, by the force of gravity, toward the fountain roller 12. A dispensing edge 66 is formed and positioned parallel and in close proximity to the cylindrical surface 18 of fountain roller 12.

The ink liner 60 extends along, and is substantially aligned with, an imaginary line tangent to the cylindrical surface 18 of the fountain roller 12. The edge 66 of ink liner 60 terminates at the roller surface 18. Alternatively, the edge 66 may extend slightly past the surface so that a flat portion 67 of the ink liner 60 is immediately adjacent to the surface 18 of fountain roller 12. The edge 66 is supported by the plurality of metering blocks 14A–O, and each metering block 14 is adjacent to a next metering block and is positioned to correspond in location to one of the zones A–O. Each metering block 14 is independently adjustable using a corresponding adjustment bolt 20; again one adjustment bolt corresponds to each metering block and each zone A–O. After adjustment of the minimum thickness using adjustment bolt 20, the metering block 14 is independently positioned by the operator within the range provided by the eccentricity of the cams 40, one for each zone A–O, for metering in the corresponding zone using cam lever arms 42, one for each zone A–O, as described above with reference to FIG. 1.

Reference to FIG. 3, which is an exploded assembly view of the ink fountain mechanism of FIGS. 1 and 2, provides additional understanding of the complete construction of the fountain mechanism 10. The pluralities of parts are indicated with numbered arrows and the individual parts are indicated with numbered leader lines such that the reference numbers correspond to the same reference numbers as in FIGS. 1 and 2.

The metering blocks 14 may be designated 14A–O corresponding to the metering zone at which a particular metering block is located. Together the metering blocks 14A–O support the edge 66 and flat portion 67 of ink liner 60 along the length of the fountain roller 12. Each metering block 14 has an upper surface 16.

Figure 4:
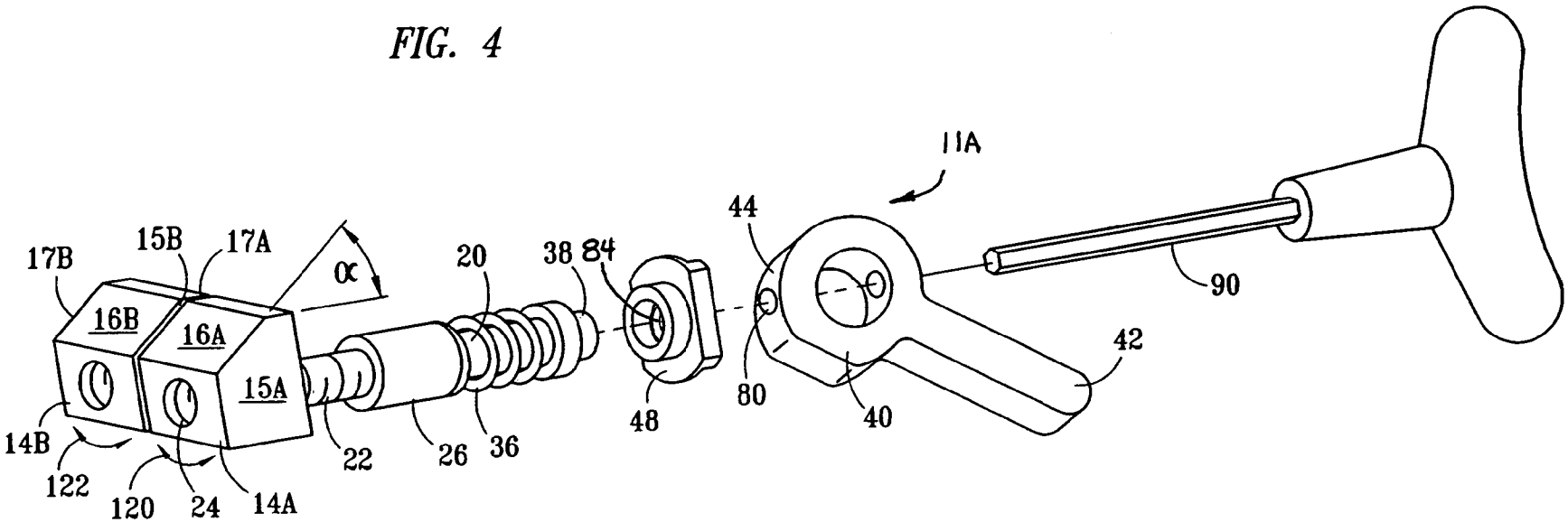
FIG. 4 is a perspective view of sub-assembly comprising a cam, interface cap and cam guide, adjustment bolt, and metering block illustrative of certain aspects of the invention.

As will be understood with reference also to FIG. 4, the surface 16 is formed on the metering block 14 as a generally planar surface at an angle a relative to horizontal. The angle of the planar surface 16 is about the same oblique angle as the ink liner 60 when supported in the fountain reservoir 64 by the inclined base 62 for operation of the ink fountain. The planar upper surface 16 of the metering block 14A–O extends across the width of each corresponding metering zone A–O from one side 15 of the metering block 14 to another side 17 of the metering block 14. The planar surface 16 is generally aligned with the ink liner 60 and the sides 15 and 17 are formed space apart slightly to provide for relative movement between adjacent metering blocks. For example, in one embodiment, the sides 15 and 17 are flat surfaces provided at vertical right angles to the upper planar surface 16 of the metering block 14. The metering blocks 14A–O are positioned side-by-side with only a very small clearance distance between adjacent sides. For example, a right side 17A of one metering block 14A and a left side 15B of a next metering block 14B may be separated by less than a thousandths of an inch (<0.0001 inch) up to a few thousands of an inch clearance. Adjacent metering blocks 14A–O are in a side-to-side movable, or relatively slideable, relationship with each other metering block. The metering blocks 14A–O are each held at an adjustable horizontal position on the threads of one of the adjustment bolts 20, yet each metering block has a limited degree of free rotational floating about the axis of the adjustment bolt 20.

Thus, while the metering blocks 14A–O are independently adjustable and partially rotatable relative to adjacent metering blocks, they also remain aligned side-by-side in a generally vertical direction. The upper planar surfaces 16 of the metering blocks 14 are in contact with the flat portion 67 at the edge 66 of ink liner 60. In operation the edge 66 of liner 60 is pushed against the surface 18 of ink fountain roller 12. The metering blocks 14 are able to "float" or rotate on the threads 26 of bolt 20 into substantially perfect parallel alignment with the surface 18 of the fountain roller 12. The partial rotational "floating" of the metering blocks 14 combines with the flexibility and resilient stiffness of the ink liner 60 to permit smooth, yet independent, adjustment of ink thickness in each zone. It has been found that a liner 60 composed of a smooth flat sheet of plastic provides a useful combination of resilient stiffness and flexibility for purposes of metering the ink to different thickness in different zones. For example, it has been found that a sheet of polyester material about 7 mils thick may be useful for this purpose.

In one embodiment, to further facilitate alignment of the plurality of metering blocks 14 and to further smooth the transition between one zone and the next, a strip of tape 110, such as durable, thin tetrafluorethylene (TFE) or polytetrafluorethylene (PTFE) tape having a thickness of a few thousandths of an inch thick. For example, a strip of TFE or PTFE tape 110 about 0.006" to about 0.007" thick and about 0.5" to about 1.0" wide may be adhered along and overlapping the planar surfaces 16A–O and the front portions of the plurality of metering blocks 14A–O. The thin flexible tape 110 is positioned at least partially under the ink liner 60 and extends along the entire length of the roller 12. The tape 110 flexibly bridges across the gap between each block 14A and the next block 14B, effectively sealing the gap between the blocks 14A–O without restricting the independent adjustment of ink thickness at each zone A–O. In the event of a spill or seepage of ink beyond the liner 60, the tape also acts to prevent penetration of ink into the gaps between the metering blocks 14A–O.

A faceplate 100 is provided to enclose the subassemblies 11. The faceplate 100 has a plurality of substantially identical vertical slots 102 to permit access to the cam lever arms 42. Each one of the plurality of slots 102 corresponds to one of the metering zones A–O. In an exemplary embodiment the face plate 100 is also provided with graduated positioning marks 104 space along and adjacent to each vertical slot 102. The operator can thus adjust the ink thickness in any given zone A–O by the position of the lever arm adjacent to that zone, for example lever arm 42A in slot 102A for adjusting zone A and lever arm 42B in slot 102B for adjusting zone B. The adjustment tool 90 is preferably only used for the initial set up to each minimum thickness to exactly zero. After the initial adjustment using adjustment tool 90, the thickness of ink can be adjustably metered using the position of the cam lever arm 42. When switching from one printing job to the next, the lever arms 42A–O, for the corresponding zones A–O, are repositioned to provide the desired amount of ink in the plurality of zones A–O. By making note of the positions of the various lever arms, the same job could be set-up again later by repositioning the lever arms to the same noted positions.

Referring again to FIG. 4, certain aspects of the invention are illustrated in a perspective view of a sub-assembly 11A comprising a cam 40 with attached lever arm 42, interface cap 48, adjustment bolt 20, bias spring 36, spacer 26 and metering block 14A. For illustration purposes only, an adjacent metering block 14B is also depicted (without the remaining portions of corresponding sub assembly 11B). Rotation arrows 120 and 122 schematically represent the partial rotational "floating" of the metering blocks 14A and 14B. It will be noted that metering block 14A is depicted in a position adjusted back from metering block 14B, such that the ink thickness in zone A at metering block 14A will be thicker than the ink thickness in zone B at metering block 14B. The adjacent sides 17A and 15B, of metering blocks 14A and 14B, respectively, are spaced apart a very small distance so that they are "floating" and can rotate for self alignment of upper surfaces 16A and 16B. The adjacent sides can also move laterally of slide with respect to each other. The angle alpha (a) of the upper flat support surfaces 16 is an oblique angle with respect to horizontal, and in the embodiment depicted, is approximately 30 degrees relative to horizontal.

Figure 5:
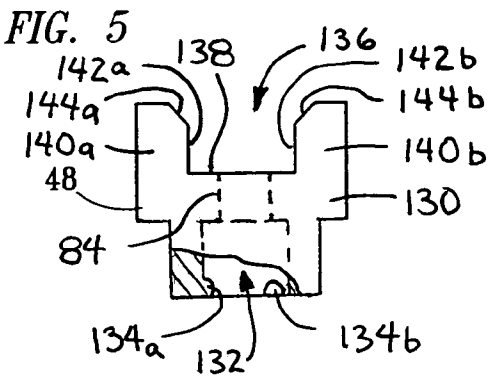
FIG. 5 is a partial sectional view of an embodiment of an interface cap for use in the sub-assembly of FIG. 4.

Referring to FIG. 5, an embodiment of an interface cap 48 for use in the sub-assembly 11A shown in FIG. 4 includes a body 130 with a socket 132 formed therein. The socket is sized to receive and accommodate the head 38 of bolt 20. To hold the cap 48 on the bolt head 38 a slight frictional interface fit is desirable. Although a snug fit can be achieved with close tolerance molding and/or machining techniques, it has been found useful and cost effective, according to alternative aspects of the invention, to form the socket 132 slightly larger than the head 38 of the bolt 20 and to provide one or more projections 134*a*, 134*b*, and 134*c* (134*c* not shown in the cutaway section), each projecting inward from the sides of the socket 132. Such a construction facilitates manufacture and molding where shrinkage and contraction of molded parts is not always precisely predictable. The projections 134*a–c* are sufficiently large to insure that there will be some contact with the bolt head 38, yet they are sufficiently small so that minor force will compress the projections 134*a–c* to allow the bolt head 38 to be inserted into the socket 132. Once the bolt head 38 is inserted, the direct surface-to-surface contact the projections 134*a–c* provides sufficient friction to hold the cap 48 from freely sliding off the head 38. The friction is sufficiently small to permit rotation for alignment with the cam 40.

The interface cap 48 is also formed with a channel 136 for receiving the cam 40. The channel 136 is positioned between walls 140*a* and 140*b*. To facilitate alignment during assembly, the interior sides 142*a* and 142*b* of walls 140*a* and 140*b*, respectively, are provided with bevels 144*a* and 144*b*, respectively. Thus, even with a large plurality of interface caps 48A–O and corresponding cams 40A–O all alignment is all that is required and then the bevels 144*a* and 144*b* will orient the channels 136 for all the zones A–O in precise alignment with the plurality of cams 40A–O.

Figure 6:
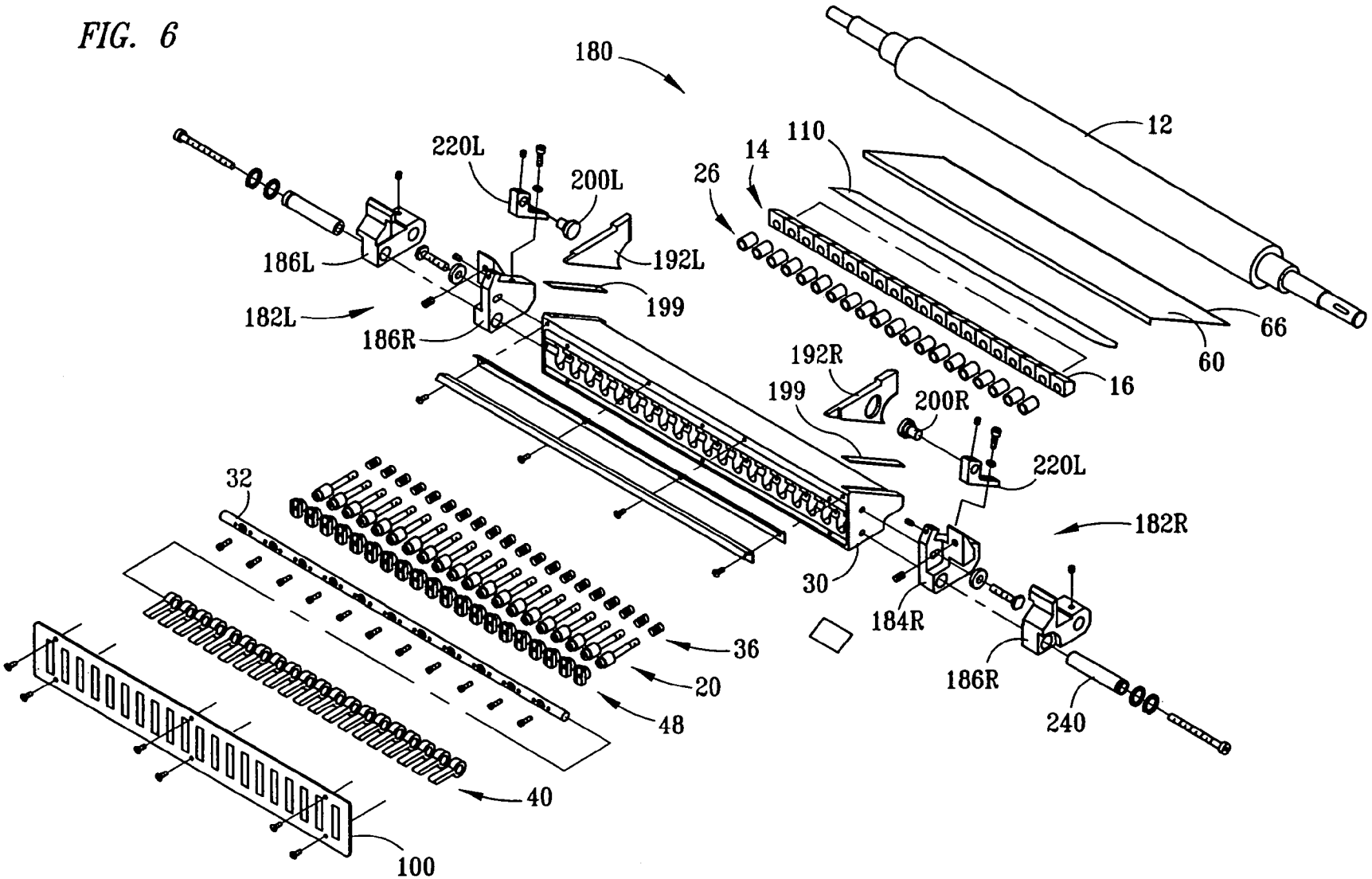
FIG. 6 is an exploded assembly view of an alternative embodiment of an ink fountain mechanism providing removable non-tilt cheeks with pivotal mounting assembly for convenient removal of a reservoir liner according to certain aspects of the present invention.

In FIG. 6 another embodiment of an ink fountain assembly 180 is shown adjacent to an ink fountain roller 12. Ink fountain mounting assemblies 182 are provided and include side frames 184 and pivot blocks 186. It will be understood that the ink fountain mounting assemblies 182 include assemblies 182R and 182L where the designations "R" for right and "L" for left are a matter of convenient reference to relative positions corresponding to the depictions shown in the figures. Other designations, such as operator side or not operator side could be used. Essentially, each right mounting assembly 182R and each left mounting assembly 182L are the mirror images of each other. The side frames 184R and 184L are similarly designated "R" for right and "L" for left, as are the pivot blocks 186R and 186L.

The side frames 184R and 184L are securely fastened to the main frame 188 of the ink fountain assembly 180. The pivot blocks 186 are pivotally mounted to the frame 230 (see FIGS. 7 and 14) of a printing press (not shown) and also to the side frames 184. A non-tilt cheek assembly 190R is attached to the side frame 184R on the right side and a non-tilt cheek assembly 190L is attached to the side frame 184L on the left side. The cheek assemblies 190 include cheek plates 192 sealingly positioned on either side of the ink reservoir 64, with the ink liner 60 extending between cheek plate 192R and cheek plate 192L. Seal strips 199R and 199L may be placed between the cheeks 192R and 192L and the liner 60 to facilitate sealing contact. The mounting assemblies 182 connect the ink fountain mechanism 10 to the printing press. As will be discussed more fully, in connection with FIGS. 14 and 15 below, the mounting assemblies 182 are constructed to provide convenient removal and replacement of the fountain liner 60.

Figure 7:
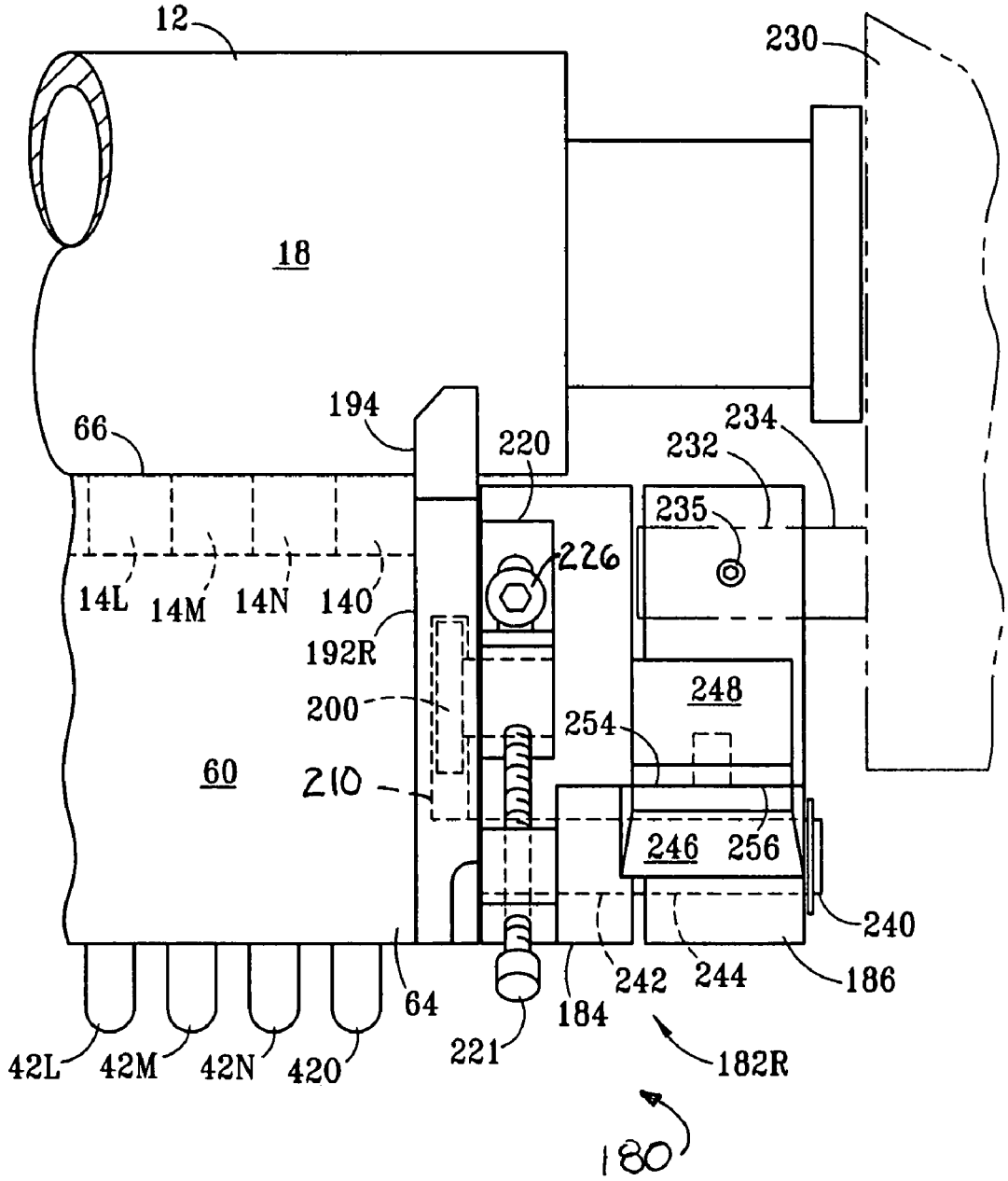
FIG. 7 is a partial top plan view of an assembled ink fountain assembly of FIG. 6, with non-tilt cheeks and mounts for convenient liner replacement.

In FIG. 7, an alternative embodiment of one side of an ink fountain assembly 180 is adjacent to an ink fountain roller 12 and is shown with a non-tilt cheek assembly 182R on the right side of the ink fountain. It will be understood that the designations R for right and L for left are for convenient reference to the drawings. Essentially each right assembly and each left assembly is the mirror image of the other. Thus , the discussion and description for the assemblies and parts designated for side "R", are also applicable to the opposite side "L", and unless specifically noted, the parts will be referred to without the location indicators R and L. The assemblies 182 include cheek plates 192 sealingly positioned on the either side of the ink reservoir 64 with the ink liner 60 extending between cheek plate 192R and cheek plate 192L (not shown). Each cheek plate 192 is provided with a curved surface 194 for sliding and ink sealing contact with the surface 18 of fountain roller 12. To facilitate providing sufficient seal pressure without excessive drag, the curved surface 124 is made narrow as by bevel 196. For clean up and ink color changes, it is useful to have cheeks that are removable. It has been found that uneven forces on the narrow curved surface can cause undesirable tilting. To prevent tilting during use, while permitting easy removal of the cheeks between use, an inventive removable non-tilt cheek holding assemblies 182 are provided, with the right assembly 182R shown.

The assembly 182R includes a side block 184 and a pivot block 186. The pivot block 186 is secured to the frame 230 of the press on a shaft 234 inserted into hole 232 and locked in place with a setscrew 235. The side frame 184 is pivotally connected to the pivot block 186 with a pivot offset shaft 240 rotatably connected through aligned holes 242 and 244 formed in the side plate and the pivot block respectively. The cheek 192 is secured to the side frame 184 using a slide block 220 that holds a cheek stud 200 that fits into a slot 210 formed in the cheek 192. A slide screw 221 is used to adjustably position the slide block 220 forward, or to release it for moving rearward, and a locking screw 226 is used to lock the slide block 220 in the adjusted position. The metering blocks 14 (only 14L, 14M, 14N, and 140 shown in FIG. 7) adjustably support the front edge 66 of the liner 60 in metered zones against the surface 18 of fountain roller 12 as described with reference to FIGS. 1–4 above.

Figure 8:
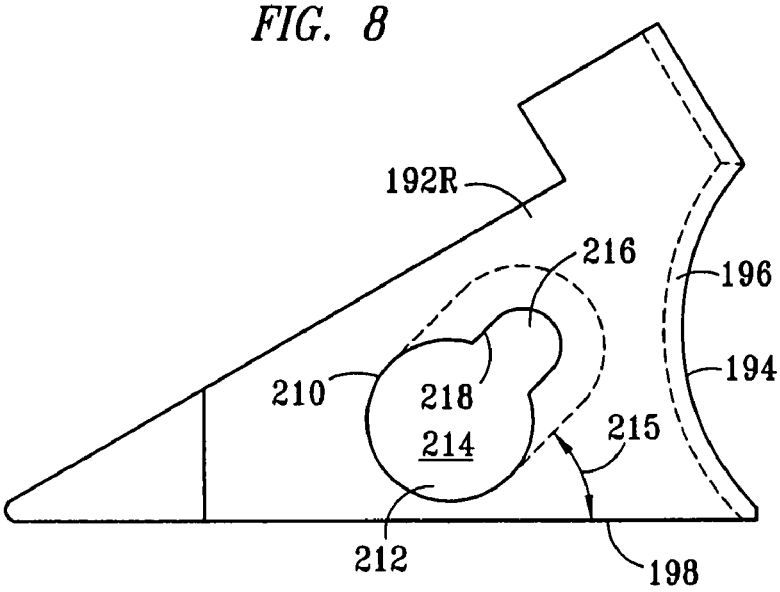
FIG. 8 is side view of the non-tilt cheek of FIGS. 6 and 7.
Figure 9:
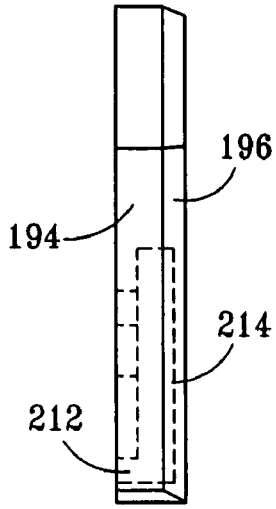
FIG. 9 is a front view of the non-tilt cheek of FIG. 8.

Shown in FIGS. 8 and 9 is a representative cheek 192R. Each cheek 192 has a curved surface 194 for sliding contact and sealing contact with the surface 18 of the fountain roller 12. To facilitate providing sufficient pressure for sealing between the curved surface 194 and the roller 12 without excessive drag, the curved surface 194 is made narrow as by a beveled edge 196. A flat bottom surface 198 is formed for sealing against the fountain liner 60. According to one aspect of this embodiment of the invention, the cheeks 192R (and 192R not shown) are removable. This facilitates cleaning the ink fountain after use and between ink color changes. According to another aspect of the invention, the cheeks 192 are attached to prevent tilting. To prevent tilting during use, while also permitting easy removal between uses, an inventive non-tilt cheek assembly 190 is provided so that the cheeks 192 are both removable and non-tilting.

Figure 10:
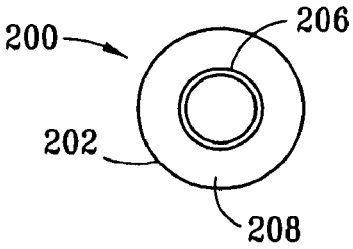
FIG. 10 is a side view of a mounting stud for holding the non-tilt cheek of FIGS. 8 and 9.
Figure 11:
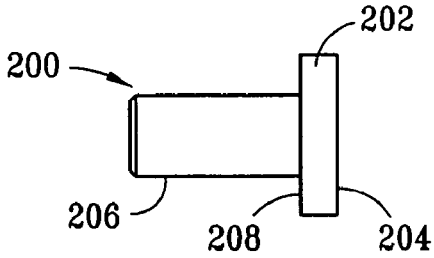
FIG. 11 is a front view of the mounting stud of FIG. 10.

Referring to FIGS. 10 and 11 along with FIGS. 8 and 9, an exemplary construction of the parts of the non-tilt cheek assembly 190 is shown. FIGS. 10 and 11 show a cheek stud 200 having a round head 202 that has a flat top 204 projecting beyond a bolt shaft 206 so that a rim 208 is formed for holding the cheek 192. The rim 208 of the stud head 202 fits into the slot 210 formed in the cheek 192. The slot 210 has a lower portion 212 that is large enough to receive the stud head 202 into the slot and against a slide surface 214. The slide surface 214 of the slot 210 is perpendicular to the bottom 198 and parallel to the sides of the cheek plate 192. The slot 210 has an upper portion 216 with an undercut lip 218 sized for engaging with the rim 208 of the cheek stud 200 with the flat top 204 of the stud head 202 positioned against the slide surface 214. The stud head 202 engages the slot 210 and holds the cheek 192 perpendicular to the axis of the roller 12 and prevents tilting of the cheek plate 192.

The construction of the cheeks includes forming the slot 210 partially through cheek plate 192 and extending from a lower portion 212 to an upper portion 214. The slot 210 is formed at an angle 215, relative to the a bottom surface 198, so that pivoting the assembly 190 into engagement between the curved sealing surface 194 and the roller 12 moves the stud head 202 to the upper portion 216 of slot 210. Pivoting the entire fountain assembly 190 away from the fountain roller 12, releases curved surface 194 from the roller 12. With the surface 194 disengaged from roller 12 the cheek plate 192 can be moved along slot 210 until the bolt head 202 is in the lower portion 214 of slot 202 and then withdrawn to remove the cheek plate 192.

Figure 12:
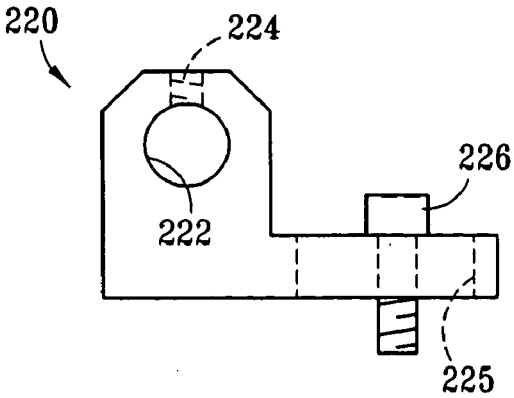
FIG. 12 is a side view of a slide block for holding the stud of FIGS. 10 and 11.
Figure 13:
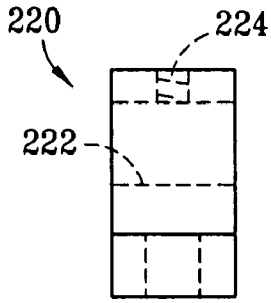
FIG. 13 is a front view of the slide block of FIG. 12.

FIGS. 12 and 13 show a slide block 220 by which the cheek stud 200 is mounted to the side frame 184. The cheek stud 200 is held by its shaft 206 at a desired position in a bore 222 formed in the slide block 220. The cheek stud 200 is secured against sliding in the bore 222 using a setscrew 224 threaded through the slide block 220 against the shaft 206 of the cheek stud 200. The slide block 220 is moveably fastened on the side frame 184. The slide block 220, with the cheek stud 200 mounted therein, is slid into position so that the bore 222 is parallel to the roller 12. Thus, the top surface 204 of the stud head 202 is perpendicular to the axis of the fountain roller 12. Slide blocks 220 are fastened to both side frame 184R and 184L and are slid forward to hold the curved surface 194 of each cheek plate 192R and 192L sealingly against fountain roller 12. The slide blocks 220 are locked into position on the side frames 184L and 184R using a lock bolt or screw 226. This also locks the cheeks 192 into position.

Figure 14:
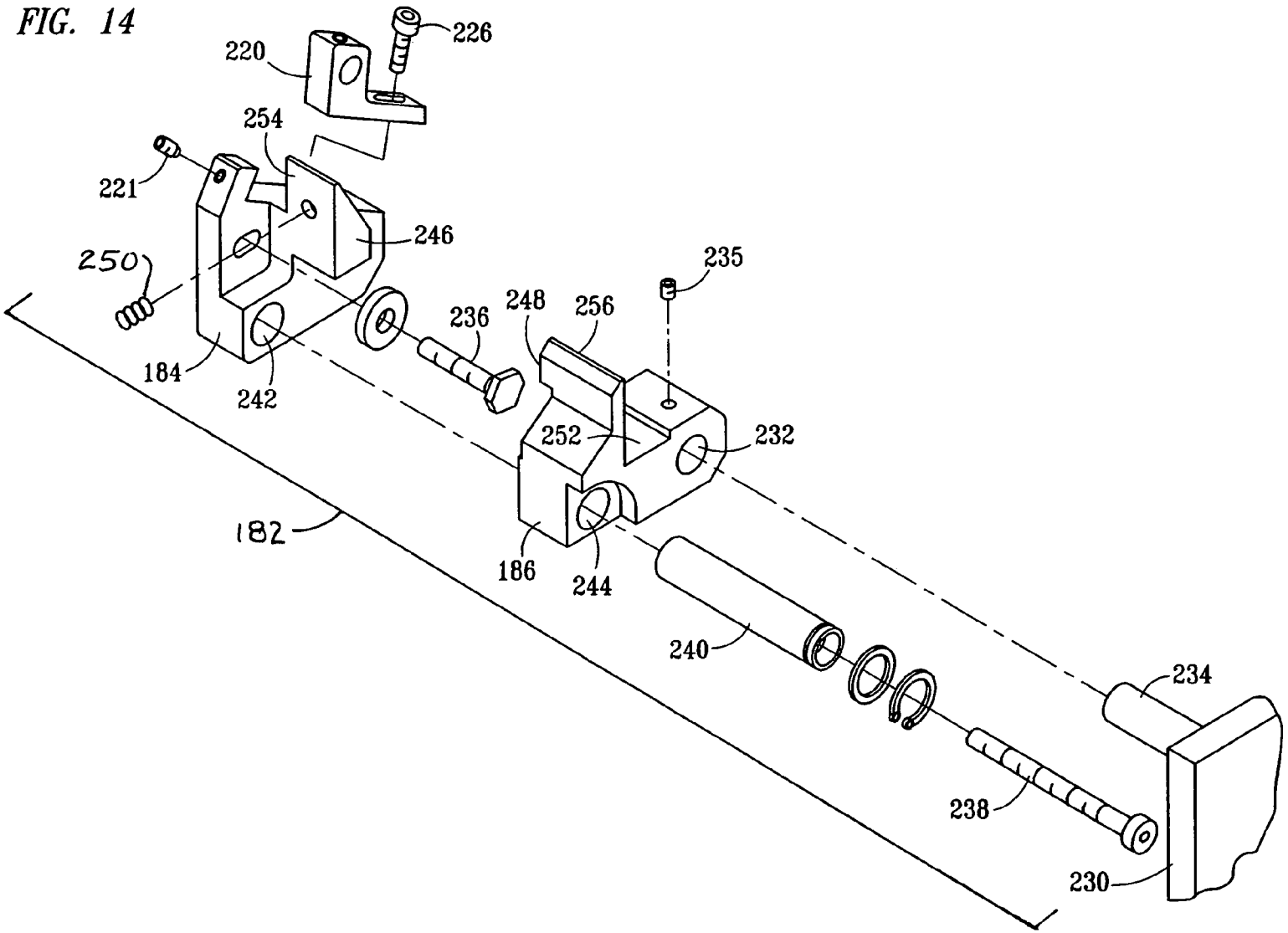
FIG. 14 is a perspective exploded assembly view of a pivotal mounting assembly for a removable non-tilt cheek, including the interconnection between a side frame and a pivot block, for providing convenient liner replacement according the embodiment of the ink fountain assembly of FIG. 6.

Referring to FIG. 14, an exemplary construction of a portion of the mounting assembly 182 is shown. With this construction the ink fountain mechanism 180 is mounted onto a printing press frame 230. The unique design permits convenient replacement of liner 60 according to one alternative embodiment of the invention. The pivot block 186 pivotally mounts to the press frame 230. For example, pivot block 186 has an orifice 232 formed there through for receiving a mounting shaft 234. The mounting shaft 234 is rigidly affixed to the press frame 230. When the ink fountain 180 is pivoted into the appropriate operating position, a setscrew 235 is tightened to prevent relative rotation between the pivot block and the mounting shaft. Side frame 184 is secured to the ink fountain main frame 30 (not shown in FIG. 14), for example with bolts 236 and 238. The side frame 184 is pivotally mounted to the pivot block 186, for example with a pivot offset shaft 240 that extends through hole 242 in the side frame 184 and through a hole 244 in the pivot block 186. Stops 246 and 248 are formed on the side frame 184 and pivot block 186 respectively. The stops 246 and 248 limit the relative pivotal movement between the side frame 184 and the pivot block 186. A spring 250 is inserted between the stops 246 and 248 to bias them apart by a small angle. Stop 246 is positioned to hit a surface 252 of block 186 to prevent pivoting beyond a desired limited amount. Surfaces 254 and 256 contact each other when the spring 250 is compressed, thereby limiting the relative pivoting in the other direction. Thus, with the pivot block 186 locked onto shaft 234 so that the ink fountain 180 is in an appropriate position for inking operation, the ink fountain 180 can be pivoted down so that the liner 60 is not against the roller 12 and is easily removable. After replacing the liner 60, the side frame 184 is pivoted about the offset pivot shaft so that stops 246 and 246 are again moved into contact and the same operating position of the ink fountain is regained. This facilitates cleaning and changing of ink colors without completely reconfiguring the position of the ink fountain 180 relative to the press 230 and the fountain roller 12.

Figure 15:
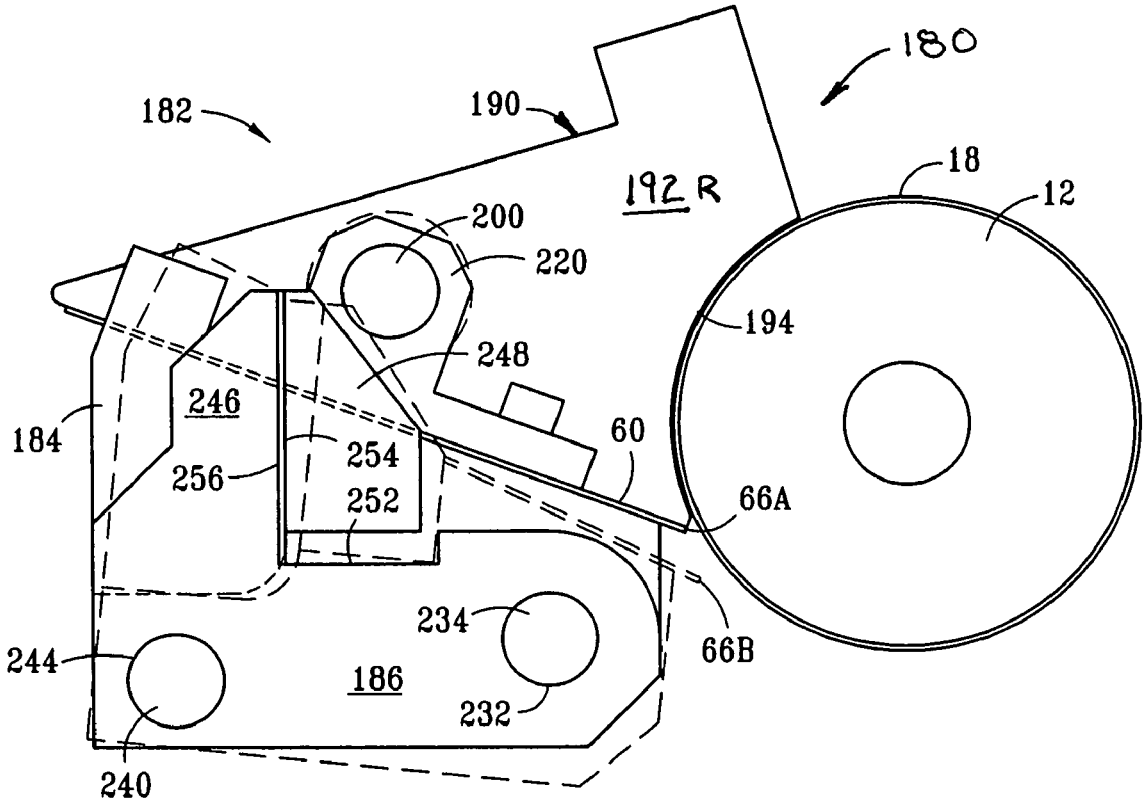
FIG. 15 is an end view of the pivotal mounting assembly according to the embodiment of FIGS. 6 and 14 and showing the side frame in a running position (in solid lines) and in a pivoted liner replacement position (in phantom lines.)

FIG. 15 is an end view of the cheek mounting assembly 182 according to the embodiment of FIGS. 6–14. The inner block 184 is shown in an operating position of relative to the outer block 186 with solid lines. Phantom lines show the position of the side frame 184 when pivoted relative the pivot block 186 for convenient replacement of liner 60. An angle of less than about 30 degrees, for example about 10 degrees to 15 degrees has been found to provide adequate clearance for removing the liner 60. In the position shown in solid lines, the liner 60 is held in place by cheek plate 192 so that the front edge 66 is supported from below (by the metering blocks 14, not shown in FIG. 15) against the surface 18 of fountain roller 12. In the position shown in phantom lines, the front edge 66 of liner 60 pivots down from the surface 18 of fountain roller 12 so that the liner 60 can be conveniently lifted and removed without binding. A cleaned liner 60 or a replacement liner 60 can be conveniently reinserted between the roller 12 and the metering blocks 14. During operation the stops 246 and 248 are forced together with a clamp or a screw (not shown) depending upon the configuration of the printing press on which the ink fountain is mounted. The cheek plate 192 is also forced forward so that the curved surface 194 sealingly slides against the surface 18 of the fountain roller 12. The ink is retained in the ink fountain reservoir and is provided to the roller 12 along the top of the front edge 66 of the liner 60. The metering blocks 14 are adjusted against the bottom of the front edge 66 of the liner 60 for proper zone-by-zone metering of ink onto the surface 18 of roller 12.

VARIATIONS AND EQUIVALENTS

It is understood that variations may be made in the foregoing without departing from the scope of the invention. For example, terms with directional connotations such as top, bottom, upper, lower, outer, inner, right, left, side and end are used in context for purposes of relative positions and the device need not be limited to absolute directions in order to fall within the scope of the invention described and claimed. While various features and embodiments are described in certain combinations and sub-combinations, selected features from one embodiment may be combined with other selected features of other embodiments without departing from certain aspects of the invention.

Although only a few exemplary embodiments of this invention have been described in detail above, those skilled in the art will readily appreciate that many other modifications are possible in the exemplary embodiments without materially departing from the novel teachings and advantages of this invention. Accordingly, all such modifications are intended to be included within the scope of this invention as described and for which applicant may be entitled to patent protection.

Although illustrative embodiments of the invention have been shown and described, a wide range of modification, changes, and substitution is contemplated in the foregoing disclosure. In some instances, some features of the present invention may be employed without a corresponding use of the other features. Accordingly, it is appropriate that the disclosure be construed broadly and in a manner consistent with the scope of the invention as set forth in the appended claims for which applicant is entitled to patent protection.

What is claimed is:

1. An ink fountain mechanism for adjustably metering the thickness of the layer of ink in a plurality of zones axially across an ink receiving fountain roller, comprising:

(a) a main beam that extends the length of the fountain roller;

(b) a plurality of metering blocks, horizontally aligned and axially adjacent to one another and each having an upper surface adjustably spaced from the ink receiving fountain roller;

(c) a plurality of adjustment bolts having heads, each separately and threadably engaged with each of the plurality of metering blocks, the adjustment bolts slideably supported in the main beam that extends the length of the fountain roller;

(d) a plurality of cams pivotably attached to the main beam and positioned adjacent to the heads of each of the adjustment bolts, the cams are engaged with the heads of the adjustment bolts and are manually actuatable between a minimum position, providing a minimum ink metered thickness, and a maximum position, providing maximum metered ink thickness;

(e) a plurality of levers attached to the cams for manually actuating the cams, the levers continuously movable between the minimum and maximum positions to provide substantially continuous metering of the thickness of ink in a range between the minimum and the maximum ink thickness; and (f) an interface cap constructed of a material selected to provide non-binding frictional sliding contact between the cam and the interface cap, wherein the interface cap further comprises a channel sized for receiving the cam and having parallel sides with a beveled edge exposed toward the cam for guiding the cam into the channel during assembly and wherein the size, shape and materials of the cap at the interface between the interface cap and the cam are selected and constructed so that the cam lever can be manually moved through the range of ink thickness metering positions, yet will remain in any desired metering position by the frictional contact between the cam and the interface cap and wherein the interface cap includes a socket for receiving the bolt head for rotation therein and includes at least one friction button projecting inwardly from a side of the socket so that the interface cap is held in place on the bolt head and the bolt head can rotate in the socket so that the bolt head effectively the interfaces against the cam through the interface cap, the interface cap having an orifice through it, and wherein the bolt head comprises a cap screw head that interfaces with the cam through the interface cap and an adjustment tool comprising an elongate wrench sized for accessing the cap head of the bolt through the cam, through the mounting shaft and through the interface cap.

2. An ink fountain mechanism for adjustably metering the thickness of the layer of ink in a plurality of zones axially across an ink receiving fountain roller, comprising:

(a) a main beam extending along the length of the fountain roller and supporting an ink reservoir;

(b) a plurality of metering blocks, horizontally aligned and axially adjacent one another and each having an upper surface adjustably spaced from the ink receiving fountain roller and below the ink reservoir;

(c) a liner forming the bottom of the reservoir and having a front edge extending to and along the fountain roller and supported from below by the plurality of metering blocks;

(d) a plurality of adjustment bolts having heads, each separately and threadably engaged with each of the plurality of metering blocks, the adjustment bolts slideably supported in the main beam that extends the length of the fountain roller;

(e) a plurality of cams pivotally attached to the main beam and positioned adjacent to the heads of each of the adjustment bolts, the cams are engaged with the heads of the adjustment bolts and are manually actuatable between a minimum position, providing a minimum ink metered thickness, and a maximum position, providing maximum metered ink thickness;

(f) a plurality of levers attached to the cams for manually actuating the cams, the levers continuously movable between the minimum and maximum positions to provide substantially continuous metering of the thickness of ink in a range between the minimum and the maximum ink thickness; and (g) non-tilting cheeks removably held on either side of the ink fountain wherein the non-tilting cheeks further comprise:

(a) a curved surface for slidably sealing against an arc of the fountain roller;

(b) a flat bottom surface for sealing against the liner of the ink reservoir; and (c) a side surface into which a groove is formed, the groove having sides, rounded ends and a flat bottom, and wherein the groove has a first open portion and a second portion with a rim projecting partially inward from the sides so that the head of a stud may be inserted into the open portion of the groove and slid to engage with the rim thereby preventing the cheek from tilting relative to the stud.

3. The ink fountain mechanism of claim 2, wherein the metering blocks comprise vertical side surfaces and a planer top support surface, wherein the metering blocks are positioned side-by-side each other with a small gap therebetween, so that the adjacent planer top support surfaces of the metering blocks define a substantially continuous support surface with independently adjustable clearance distances from the fountain roller at each metering block along the length of the fountain roller.

4. The ink fountain mechanism of claim 2, further comprising the ink liner supported along the substantially continuous support surface formed by the planer top surfaces of the metering blocks, the ink liner comprising a thin sheet of resilient and flexible material.

5. The ink fountain mechanism of claim 4, wherein the thin sheet of flexible resilient material of the ink liner comprises a sheet of plastic material.

6. The ink fountain mechanism of claim 5, wherein the thin sheet of flexible resilient plastic material of the ink liner comprises a sheet of polyester about 7 mils thick.

7. An ink fountain mechanism for adjustably metering the thickness of the layer of ink in a plurality of zones axially across an ink receiving fountain roller, comprising:

(a) a main beam that extends substantially the length of the fountain roller;

(b) a plurality of metering blocks, horizontally aligned and axially adjacent to one another and each having an upper surface adjustably spaced from the fountain roller;

(c) a plurality of adjustment bolts having heads, each separately and threadably engaged with each of the plurality of metering blocks, the adjustment bolts slideably supported in the main beam that extends the length of the fountain roller;

(d) a plurality of cams pivotably attached to the main beam and positioned adjacent to the heads of each of the adjustment bolts, the cams are engaged with the heads of the adjustment bolts and are manually actuatable between a minimum position, providing a minimum ink metered thickness, and a maximum position, providing maximum metered ink thickness;

(e) a plurality of levers attached to the cams for manually actuating the cams, the levers continuously movable between the minimum and maximum positions to provide progressive metering of the thickness of ink in a range between the minimum and the maximum ink thickness;

(f) a mounting assembly including fountain side frames and pivot blocks, the mounting assembly pivotally mounted between the ink fountain mechanism and a printing press and having a lockable position for holding the ink fountain with a replaceable liner against the fountain roller and having a second pivot position at which the replaceable liner is spaced away from the fountain roller for convenient removal of the replaceable liner; and (g) non-tilting cheeks comprising;

(i) a curved surface for slidably sealing against an arc surface of the fountain roller;

(ii) a flat bottom surface for sealing against the liner of the ink reservoir; and (iii) a side surface, into which a slot is formed, the slot having sides, rounded ends and a lip extending partially into the slot, and wherein the slot has a first open portion and a second portion with lip projecting partially inward from the sides so that the head of a stud may be inserted into the open portion of the slot and slid to engage with the rim thereby preventing the cheek from tilting relative to the stud.

* * * * *